US007681538B2

(12) United States Patent
Hiyoshi et al.

(10) Patent No.: US 7,681,538 B2
(45) Date of Patent: Mar. 23, 2010

(54) INTERNAL COMBUSTION ENGINE EMPLOYING VARIABLE COMPRESSION RATIO MECHANISM

(75) Inventors: Ryosuke Hiyoshi, Kanagawa (JP); Shinichi Takemura, Kanagawa (JP); Yoshiaki Tanaka, Kanagawa (JP)

(73) Assignee: Nissan Motor Co., Ltd., Yokohama-shi, Kanagawa (JP)

( * ) Notice: Subject to any disclaimer, the term of this patent is extended or adjusted under 35 U.S.C. 154(b) by 0 days.

(21) Appl. No.: 12/050,440

(22) Filed: Mar. 18, 2008

(65) Prior Publication Data

US 2008/0283008 A1 Nov. 20, 2008

(30) Foreign Application Priority Data

May 15, 2007 (JP) ..... 2007-129101

(51) Int. Cl.
*F02B 75/04* (2006.01)

(52) U.S. Cl. ..... 123/48 B; 123/78 F

(58) Field of Classification Search ..... 123/48 R, 123/48 B, 78 R, 78 F
See application file for complete search history.

(56) References Cited

U.S. PATENT DOCUMENTS

| | | | | |
|---|---|---|---|---|
| 1,874,194 | A | 8/1932 | King | |
| 2,822,791 | A | 2/1958 | Biermann | |
| 4,917,066 | A | 4/1990 | Freudenstein et al. | |
| 2002/0117129 | A1 * | 8/2002 | Aoyama et al. | 123/48 B |

FOREIGN PATENT DOCUMENTS

| | | |
|---|---|---|
| FR | 2 802 973 A1 | 6/2001 |
| GB | 2 103 751 A | 2/1983 |
| JP | 2002-115571 | 4/2002 |
| JP | 2007-071108 | 3/2007 |

* cited by examiner

*Primary Examiner*—Noah Kamen
(74) *Attorney, Agent, or Firm*—Drinker Biddle & Reath LLP

(57) ABSTRACT

An internal combustion engine which varies a compression ratio by changing a top dead center position of a piston, including an engine block, the piston disposed in the engine block, a crank shaft supported by the engine block, and a plurality of links connecting the piston and the crank shaft. A first control shaft and a second control shaft respectively are supported by the engine block, each of which has a main shaft portion rotatably supported by the engine block and an eccentric portion eccentric to the main shaft portion, the eccentric portions of the first control shaft and the second control shaft deviating from axes of the respective main shaft portions in mutually different directions when viewed from an axial direction. A plurality of control links connect any one of the plurality of links connecting the piston and the crank shaft, and the first control shaft and the second control shaft. A driving unit is provided at least one of the first control shaft and the second control shaft, that rotates the control shaft.

20 Claims, 12 Drawing Sheets

AT MEDIUM COMPRESSION RATIO

INTERNAL COMBUSTION ENGINE EMPLOYING VARIABLE COMPRESSION RATIO MECHANISM

CROSS-REFERENCE TO RELATED APPLICATIONS

This application claims priority to Japanese Patent Application No. 2007-129101 filed May 15, 2007, which is incorporated by reference herein in the entirety.

BACKGROUND OF THE INVENTION

1. Field of the Invention

The present invention relates to a variable compression ratio mechanism, and more particularly to a configuration to reduce a load that acts on an actuator which drives the variable compression ratio mechanism.

2. Description of Related Art

As a variable compression ratio mechanism of an internal combustion engine, the variable compression ratio mechanism in which a piston and a crank are linked through a plurality of links has been known. For example, in the related art, the piston and the crank are linked through an upper link and a lower link, and by controlling an attitude of the lower link, a compression ratio is variably controlled.

More specifically, a control link, one end of which is linked to the lower link, and the other end of which is linked to an eccentric shaft provided at a control shaft that extends substantially parallel with a crank shaft, is employed. Then, by changing a rotation angle of the control shaft (control shaft angle), the attitude of the lower link is controlled through the control link.

The control of the rotation angle of the control shaft is carried out by an actuator that is formed from a fork fixedly connected to the control shaft, an actuator rod having a ball screw shaft portion and linking to the fork through a link pin, a driving motor, a ball screw speed reducer, and a compression ratio holding mechanism to hold a set compression ratio even when an external force of a combustion pressure etc. acts.

BRIEF SUMMARY OF THE INVENTION

However, in the above-described configuration, since the combustion pressure and/or an inertial force of each link act on positions eccentric to a rotation axis of the control shaft through the control link, a rotational torque acts on the control shaft. Because of this, the load also acts on the actuator which links to the control shaft. Therefore, as the load acting on the control shaft becomes greater, the load acting on the actuator also becomes greater. Thus, a larger actuator is needed.

In the present invention, in order to solve the above problem, a goal is to reduce the load acting on the control shaft, and also to reduce the load acting on the actuator.

In an embodiment, the invention provides an internal combustion engine which varies a compression ratio by changing a top dead center position of a piston, including an engine block, the piston disposed in the engine block, a crank shaft supported by the engine block, and a plurality of links connecting the piston and the crank shaft. A first control shaft and a second control shaft respectively are supported by the engine block, each of which has a main shaft portion rotatably supported by the engine block and an eccentric portion eccentric to the main shaft portion, the eccentric portions of the first control shaft and the second control shaft deviating from axes of the respective main shaft portions in mutually different directions when viewed from an axial direction. A plurality of control links connect any one of the plurality of links connecting the piston and the crank shaft, and the first control shaft and the second control shaft. A driving unit is provided at least one of the first control shaft and the second control shaft, that rotates the control shaft.

In another embodiment, the invention provides a method of varying a compression ratio of an internal combustion engine by changing a top dead center position of a piston. The engine includes an engine block, the piston, a crank shaft, and a plurality of links connecting the piston and the crank shaft. The method includes providing a first control shaft and a second control shaft respectively supported by the engine block, each of which has a main shaft portion rotatably supported by the engine block and an eccentric portion eccentric to the main shaft portion, the eccentric portions of the first control shaft and the second control shaft deviating from axes of the respective main shaft portions in mutually different directions when viewed from an axial direction, providing a plurality of control links which connect any one of the plurality of links connecting the piston and the crank shaft, and the first control shaft and the second control shaft, and operating a driving unit that rotates at least one of the first control shaft and the second control shaft.

According to the present invention, by sharing the combustion load and the inertial force of each movable component with a plurality of control shafts, and receiving it by the each control shaft, an acting control shaft torque per control shaft is reduced. Therefore, it is possible to reduce a maximum load that acts on the actuator rod of the actuator formed from the driving unit and holding unit. In this manner, the problems of the related art can be overcome.

BRIEF DESCRIPTION OF THE DRAWINGS

The accompanying drawings, which are incorporated herein and constitute part of this specification, illustrate preferred embodiments of the invention, and together with the general description given above and the detailed description given below, serve to explain features of the invention.

DETAILED DESCRIPTION OF THE PREFERRED EMBODIMENTS

Hereinafter, embodiments of the present invention will be explained in detail with reference to the drawings.

Figure 1A:
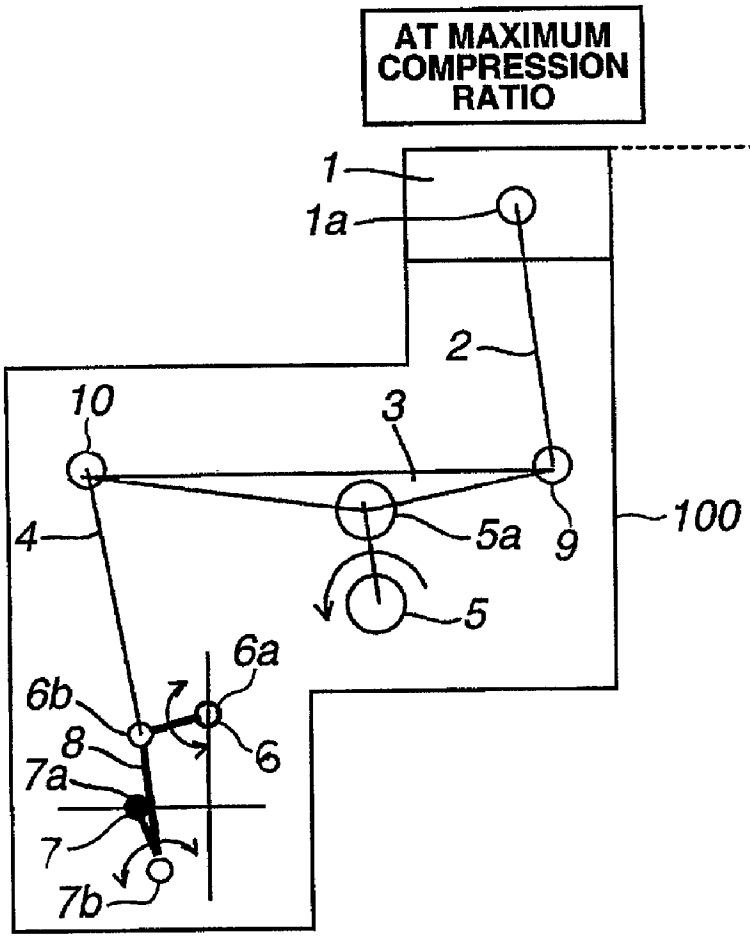
FIGS. 1A and 1B are schematic views of a configuration of a variable compression ratio mechanism of a first embodiment.
Figure 1B:
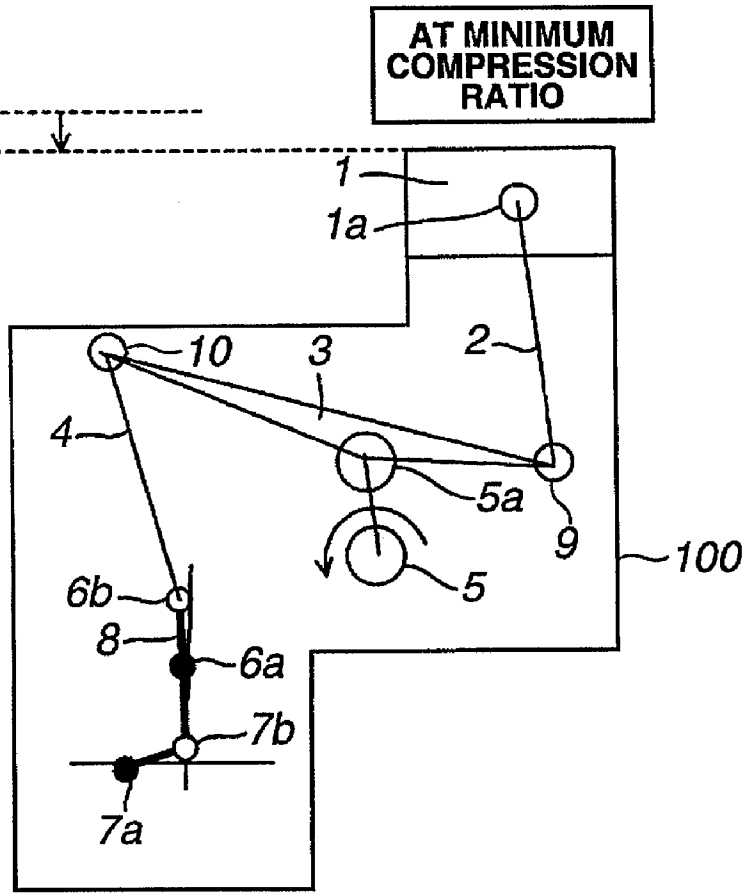

FIG. 1 shows a schematic view of configuration of a duplex or multiple link type link variable compression ratio mechanism applied to a first embodiment. FIG. 1A is a drawing showing a state at maximum compression ratio. FIG. 1B is a drawing showing a state at minimum compression ratio. In FIG. 1, a mechanism that drives the variable compression ratio mechanism, and a holding mechanism that holds a set compression ratio, are eliminated.

With regard to the multiple link type link variable compression ratio mechanism, its configuration, mechanism in which the compression ratio varies, and control manner of the compression ratio, etc. are the same as those of the related art multiple link type link variable compression ratio mechanism, except for an after-mentioned plurality of control shaft portions. Thus, its detailed explanation is eliminated here.

FIG. 1 shows a piston 1, an upper link 2, a lower link 3, a control link 4, a crank shaft 5, a first control shaft 6, a second control shaft 7, a connection link 8, and an engine block 100.

The piston 1 is installed inside a cylinder of the engine block 100 so that the piston 1 is capable of reciprocating motion. The first control shaft 6 and the second control shaft 7 extend substantially parallel to the crank shaft 5 in a direction of a line of the cylinders. A main shaft 6*a* and a main shaft 7*a* of the respective control shafts 6 and 7 are rotatably supported by the engine block 100. The lower link 3 is linked to a crank pin 5*a* of the crank shaft 5 so that the lower link 3 can relatively rotate. In the drawings, the crank shaft 5 rotates in a counterclockwise direction.

Regarding the upper link 2, its upper end and lower end are respectively linked to the piston and the lower link 3 through the piston pin 1*a* and a connection pin 9, so that each end can relatively rotate.

As for the control link 4, its upper end is linked to the lower link 3 through a connection pin 10 and a lower end of the control link 4 is linked to the first control shaft 6 so that each end can relatively rotate. More specifically, the control link 4 is linked to a position (an eccentric shaft) 6*b* eccentric to the main shaft 6*a* of the first control shaft 6.

With respect to the connection link 8, its one end is linked to the eccentric shaft 6*b* of the first control shaft 6, and the other end is linked to a position (an eccentric shaft) 7*b* eccentric to main shaft 7*a* of the second control shaft 7 so that each end can relatively rotate.

Here, the eccentric shaft 6*b* to which the control link 4 is linked, and the eccentric shaft 6*b* to which the connection link 8 is linked, are respectively positioned at different positions along shaft 6*b* as shown in FIG. 2 (described later). However, since both positions deviate or shift from the main shaft 6*a* to the same position when viewed from an engine front side, these positions are considered to be at the eccentric shaft 6*b*, for convenience.

In the embodiment, by using an after-mentioned actuator, the first control shaft 6 and the second control shaft 7 are driven. Then, the lower link 3 linked to the first control shaft 6 through the control link 4, tilts or inclines with the crank pin 5*a* being an axis, and a position of the piston 1, linked to the lower link 3 through the upper link 2, is varied or changed.

In the drawings, when the first control shaft 6 rotates in a clockwise direction, the lower link 3 also rotates in the clockwise direction and a top dead center (TDC) position of the piston 1 descends or goes down. Then, when a slope or inclination in the clockwise direction of the lower link 3 becomes maximum, as shown in FIG. 1(*b*), the compression ratio becomes the minimum compression ratio. On the other hand, when the first control shaft 6 rotates in the counterclockwise direction in the drawing, the lower link 3 also rotates in the counterclockwise direction and the top dead center (TDC) position of the piston 1 rises or goes up. Then, when the inclination in the counterclockwise direction of the lower link 3 becomes maximum, as shown in FIG. 1(*a*), the compression ratio becomes the maximum compression ratio.

Figure 2B:
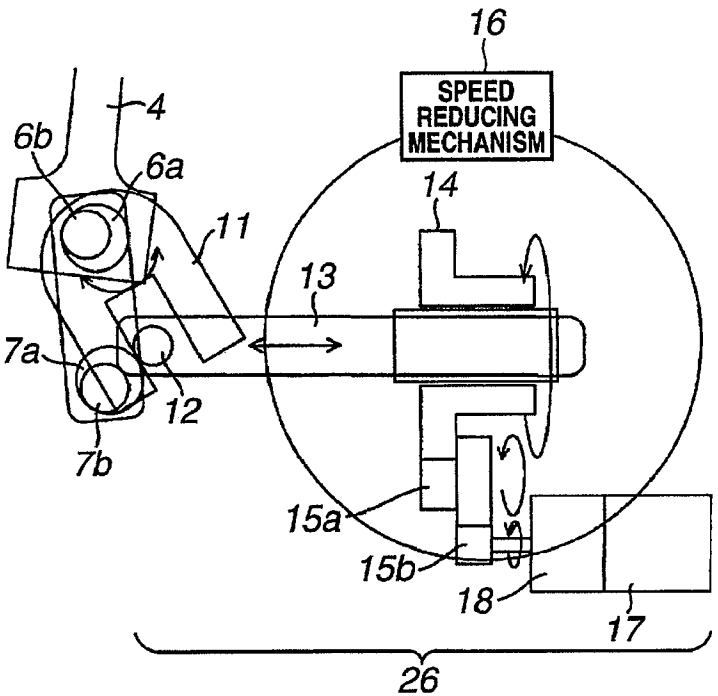
FIGS. 2A and 2B are schematic views of a configuration around first and second control shafts, respectively viewed from the front and a side of an engine.
Figure 2A:
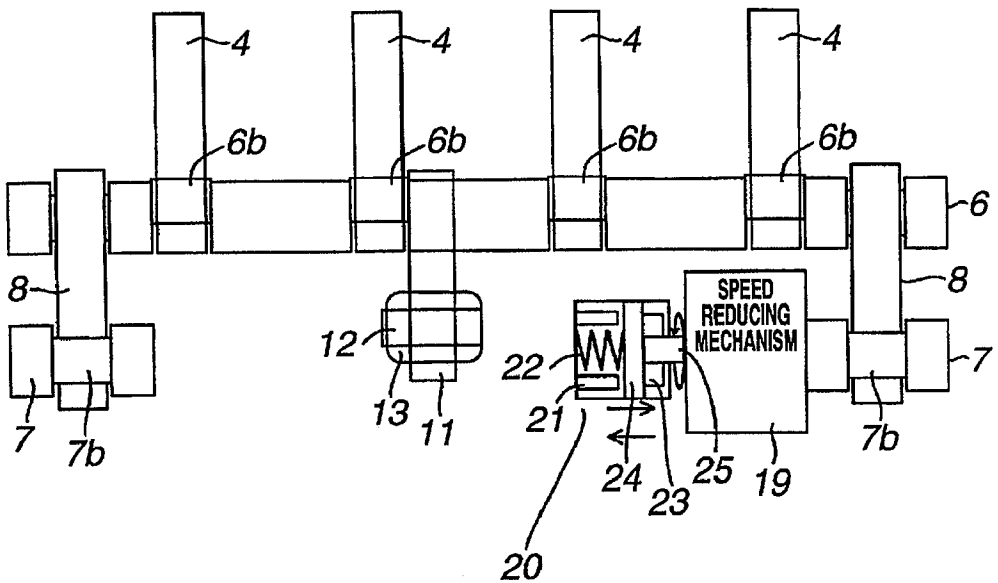

FIG. 2A is a drawing of a configuration around the first control shaft 6 and the second control shaft 7, viewed from the engine side. FIG. 2B is a drawing, viewed from the engine front.

The Figures show a fork member 11, a connection pin 12, a driving side speed reducing mechanism 16, an electric motor 17, a driving side angle holding mechanism 18, a non-driving side speed reducing mechanism 19, and a non-driving side angle holding mechanism 20.

As shown in FIG. 2A, the control links 4 of all the cylinders arranged in the same cylinder line are connected with one first control shaft 6. The second control shaft 7 is connected or linked to the first control shaft 6 through at least one connection link 8.

The fork member 11 is fixedly supported by the first control shaft 6, and an after-mentioned actuator rod 13 is linked to fork member 11 through the connection pin 12.

The driving side speed reducing mechanism 16 is formed from the actuator rod 13 whose one portion on a base end side is integrally formed with or connected to a ball screw shaft and a ball screw nut 14 whose one part on an outer side is formed into a shape of a spur gear, and a top portion of the actuator rod 13 is connected with the fork member 11 through the connection pin 12. The ball screw nut 14 is driven and rotates by the electric motor 17 via a spur gear 15*a* that engages with the spur gear formed on the outer side of the ball screw nut 14, and a spur gear 15*b* that engages with the spur gear 15*a* and is supported by a shaft of the electric motor 17. With this linkage, the actuator rod 13 shifts, and then the first control shaft 6 is rotated via the fork member 11.

Between the electric motor 17 and the driving side speed reducing mechanism 16, the driving side angle holding mechanism 18 is installed.

A configuration of the driving side angle holding mechanism 18 is the same as that of the after-mentioned non-driving side angle holding mechanism 20, and it is the one that prevents the rotation of the shaft of the electric motor 17. When the rotation of the electric motor 17 is prevented, since the rotations of the spur gear 15 and the ball screw nut 14 are also prevented, the actuator rod 13 becomes incapable of the shifting motion. That is, the first control shaft 6 linked to the actuator rod 13 via the fork member 11 cannot rotate. Thus, when a torque of the rotational direction acts on the first control shaft 6 due to a combustion pressure and/or an inertial force of each part or component, the rotation of the first control shaft 6 can be prevented. That is to say, it is possible to prevent the compression ratio from shifting or deviating from a set value of the compression ratio due to the combustion pressure etc.

The non-driving side angle holding mechanism 20 is formed from a disc 23 fixedly supported by an output shaft 25 of the non-driving side speed reducing mechanism 19, an armature 24 facing the disc 23, a spring 22 forcing or biasing the armature 24 toward the disc 23, and a coil 21 provided to surround or cover the spring 22.

In a condition in which no voltage is applied to the coil 21, the armature 24 is pressed to the disc 23 by the biasing force of the spring 22, and therefore a rotation of the output shaft 25 is prevented. That is, in a case where a frictional force (a holding torque) between the armature 24 and the disc 23 is greater than a rotational torque of the output shaft 25, the rotation of the output shaft 25 can be prevented.

On the other hand, when the voltage is applied to the coil 21, since the armature 24 separates from the disc 23 against the biasing force of the spring 22 and sticks to the coil 21, the disc 23 can rotate freely.

Here, as for the configuration of the driving side angle holding mechanism 18, it is basically the same as that of the non-driving side angle holding mechanism 20, except that the shaft of the electric motor 17, corresponding to the output shaft 25, penetrates an inside of the holding mechanism.

A configuration of the non-driving side speed reducing mechanism 19 is the same as that of a normal speed reducing mechanism, in that it is the one that reduces rotation (or speed of the rotation) of an input shaft and the output shaft 25 by installing gears etc. between the second control shaft 7 as the input shaft and output shaft 25.

With regard to the driving side angle holding mechanism 18 and the non-driving side angle holding mechanism 20, one of them which can hold the angles of the first and second control shafts 6, 7 with a smaller holding torque is operated, namely the mechanism at a side of the control shaft where an acting control shaft torque is smaller than the other, is operated. For example, if the control shaft torque for each rotational angle for the first and second control shafts 6, 7 is previously calculated or stored, on the basis of the rotational angle as a compression ratio command value from a control unit (not shown), a decision which mechanism should be operated can be made.

Here, a gathering or group of the electric motor 17, the driving side speed reducing mechanism 16, the driving side angle holding mechanism 18, and the spur gear 15, is called an actuator 26.

Next, an arrangement of the first control shaft 6 and the second control shaft 7 will be explained.

Figure 3A:
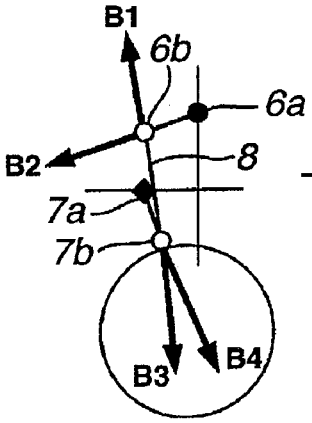
FIGS. 3A to 3C are drawings respectively showing a state of the first control shaft, a connection link and the second control shaft, in the cases of maximum compression ratio, medium compression ratio, and minimum compression ratio.
Figure 3B:
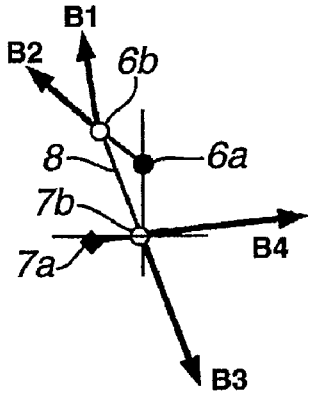
Figure 3C:
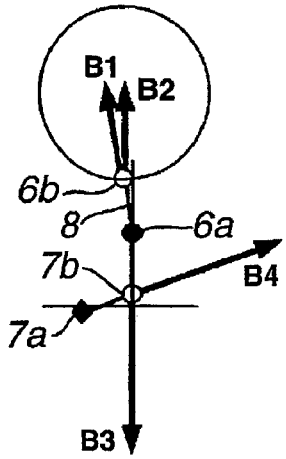

FIGS. 3A, 3C and 3B are drawings showing a state of the first control shaft 6, the second control shaft 7 and the connection link 8, respectively in the cases of the maximum compression ratio, the minimum compression ratio, and the medium compression ratio between the maximum and minimum compression ratios. In the drawings, regarding the first control shaft 6 and the second control shaft 7, only the main shafts 6*a* and 7*a* and the eccentric shafts 6*b* and 7*b* are illustrated. An arrow B1 indicates a load vector that acts on the eccentric shaft 6*b* of the first control shaft 6 from the connection link 8, an arrow B2 indicates a vector of a direction of the eccentric shaft 6*b* from the main shaft 6*a* of the first control shaft 6, an arrow B3 indicates a vector of a longitudinal direction of the connection link 8, and an arrow B4 indicates a vector of a direction of the eccentric shaft 7*b* from the main shaft 7*a* of the second control shaft 7.

Figure 4A:
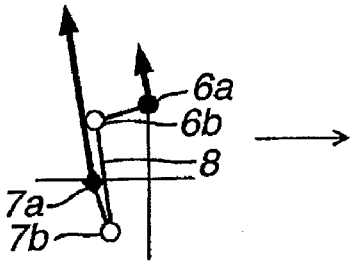
FIGS. 4A to 4C are drawings respectively showing the load that acts on the first and second control shafts, in the cases of maximum compression ratio, medium compression ratio, and minimum compression ratio.
Figure 4B:
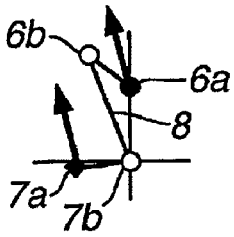
Figure 4C:
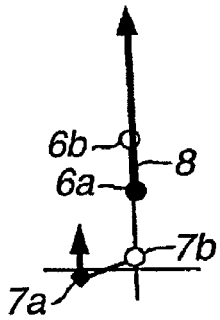

FIGS. 4A to 4C are drawings that show loads acting on the first control shaft 6 and the second control shaft 7 in the conditions of FIGS. 3A to 3C, respectively. An arrow indicates an acting direction and a size or magnitude of the load.

As shown in FIG. 3, the main shafts 6*a* and 7*a*, the eccentric shafts 6*b* and 7*b* and a length of the connection link 8, etc. are set so that the vector B3 and the vector B4 become closest to a parallel state at the maximum compression ratio, and the vector B1 and the vector B2 become closest to a parallel state at the minimum compression ratio.

Further, the eccentric shafts 6*b* and 7*b*, and the arrangement of the connection link 8, are set so that the vector B2 and the vector B3 are substantially perpendicular to each other.

By this setting, at the maximum compression ratio, with regard to a load (the vector B1) that acts on the first control shaft 6 from the connection link 8, a component that rotates the first control shaft 6 about the main shaft 6*a* becomes large, and a component that acts in a direction of the vector B2, that is, a load that acts on the main shaft 6*a*, becomes small. On the other hand, since a load (the vector B3) that acts on the eccentric shaft 7*b* via the connection link 8 is close to parallel to the vector B4, a component that rotates the second control shaft 7 about the main shaft 7*a* becomes small, and a component in a direction of the vector B4, that is, a load that acts on the main shaft 7*a*, becomes large. Hereafter, a torque that acts in the rotational direction of the main shafts 6*a* and 7*a* by the load respectively acting on the eccentric shafts 6*b* and 7*b* of the first and second control shafts 6 and 7, is called a control shaft torque.

At the minimum compression ratio, in contrast to the case of the maximum compression ratio, the load that acts on the main shaft 6*a* becomes large, and the load that acts on the main shaft 7*a* becomes small.

Here, the load that acts on the first control shaft 6 becomes smallest at the maximum compression ratio, and it becomes largest at the minimum compression ratio. The load that acts on the second control shaft 7 becomes largest at the maximum compression ratio, and it becomes smallest at the minimum compression ratio.

At the minimum compression ratio, although the load that acts on the first control shaft 6 becomes largest, since the vector B1 and the vector B2 are close to parallel to each other, there is almost no rotational direction component of the load, and the control shaft torque becomes small. At this time, the load that acts on the eccentric shaft 7*b* of the second control shaft 7 is a maximum value, and most of it becomes a component that rotates the second control shaft 7.

Here, as the vector B1 and the vector B2 are closer to parallel to each other, the first control shaft 6 becomes less apt to rotate when the load acts on the eccentric shaft 6*b* from the connection link 8. Then, when the first control shaft 6 becomes less apt to rotate, the second control shaft 7 linked to the first control shaft 6 via the connection link 8, also becomes less apt to rotate.

That is to say, since the connection link 8 prevents the rotation of the second control shaft 7, a load that acts on the actuator 26 is reduced at the minimum compression ratio, and a torque required to prevent the rotation of the first control shaft 6 by the actuator 26 can become small at the minimum compression ratio.

On the other hand, at the maximum compression ratio, in contrast to the case of the above minimum compression ratio, although the load that attempts to rotate the first control shaft 6 becomes large, since the rotation is prevented by the connection link 8, the load that acts on the actuator 26 and the torque required to prevent the rotation of the first control shaft 6 by the actuator 26, can become small.

If friction between the main shaft 7*a* of the second control shaft 7 and a bearing (not shown) is large, the second control shaft 7 becomes less apt to rotate. By this friction, the torque required to prevent the rotation of the first control shaft 6 can be further reduced.

Furthermore, since the control shaft torque can be reduced at both of the maximum and minimum compression ratios in which the load that acts on the first control shaft 6 or the second control shaft 7 becomes maximum, as a matter of course, also at the medium compression ratio in which the acting load is smaller than the maximum value, the reducing effect of the control shaft torque can be gained. That is, since the control shaft torque can be reduced throughout the compression ratio from the maximum compression ratio to the minimum compression ratio, the load that acts on the actuator 26 can be reduced.

Here, also in a case where the actuator 26 is connected with the second control shaft 7, in the same way as the above, the load that acts on the actuator 26 can be reduced.

Figure 5:
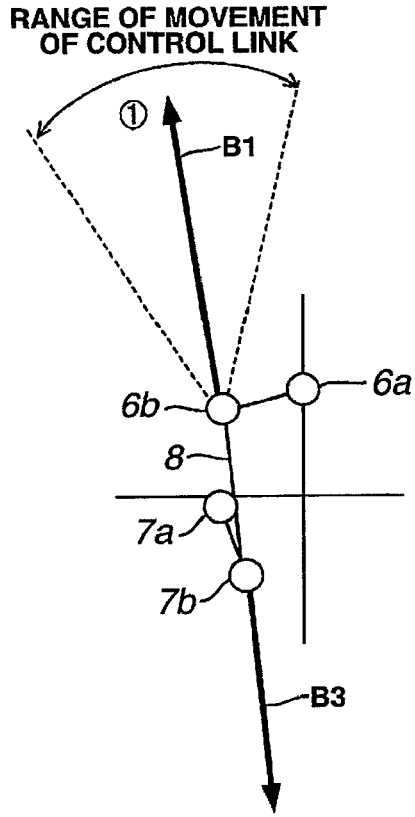
FIG. 5 is a drawing showing a relationship between a vector B1 and a vector B3 at a predetermined crank angle.

FIG. 5 is a drawing showing a relationship between the vector B1 and the vector B3 at a predetermined crank angle. In the drawing, a broken line indicates a range of movement or wobbling or swinging of the control link 4, according to change of crank angle. Here, the movement range of the control link 4 is nearly equal to a movement range of the vector B1.

As shown in FIG. 5, the first control shaft 6, the second control shaft 7, and the arrangement of the connection link 8, are set so that the vector B1 and the vector B3 are substantially parallel to each other at the predetermined crank angle at the maximum compression ratio.

Figure 6:
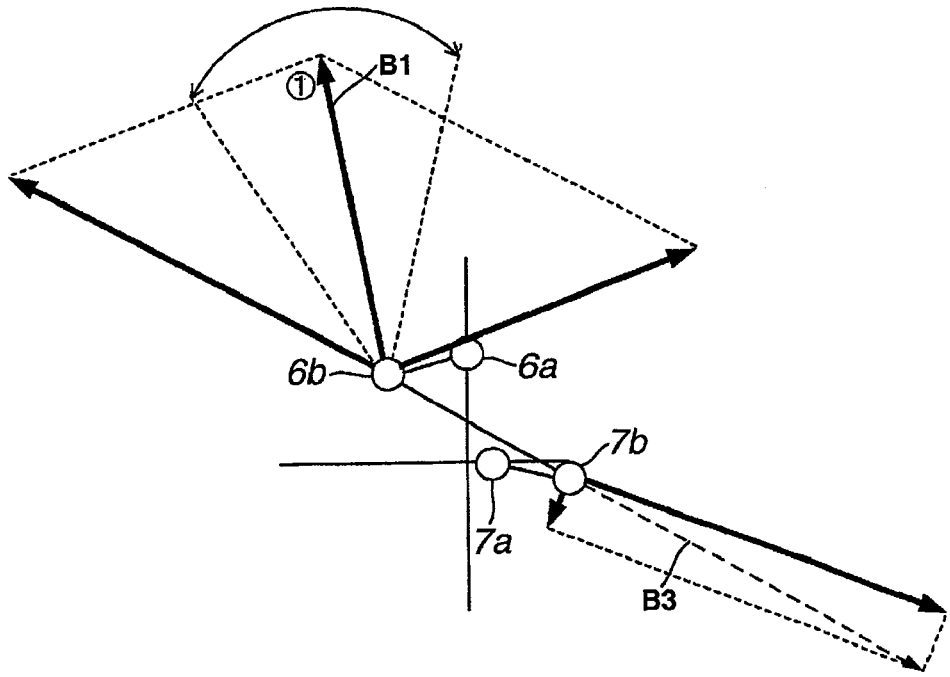
FIG. 6 is an example in which the vector B1 and the vector B3 are not parallel with each other at any crank angle.

Effects gained by these setting will be explained with reference to FIGS. 5 and 6. FIG. 6 is a drawing showing a case in which the vector B1 and the vector B3 are not parallel to each other at any crank angle at the same compression ratio as FIG. 5.

In the case of FIG. 5, since the vector of the longitudinal direction of the connection link 8 (vector B3), and the vector of the direction of the main shaft 6*a* from the eccentric shaft 6*b*, are substantially perpendicular to each other, a component of force of the direction of the main shaft 6*a* from the eccentric shaft 6*b*, of the load that acts on the eccentric shaft 6*b* (vector B1), (that is, a bearing load of the main shaft 6*a*), almost does not arise. The load that acts on the first control shaft 6 becomes the load that acts on the second control shaft 7.

In contrast, in a case of FIG. 6, the vector B1 is resolved into a component of force of the longitudinal direction of the connection link 8, and a component of force of the direction of the main shaft 6*a* from the eccentric shaft 6*b*. That is, since the component of force of the direction of the main shaft 6*a* from the eccentric shaft 6*b* arises, the bearing load of the first control shaft 6 becomes large as compared with the case of FIG. 5.

Further, in the case of FIG. 6, although the component of force of the longitudinal direction of the connection link 8 becomes the load that acts on the eccentric shaft 7*b*, and a component of force of the direction of the eccentric shaft 7*b* from the main shaft 7*a*, of the load that acts on the eccentric shaft 7*b* becomes the load that acts on the second control shaft 7, the component of force of the longitudinal direction of the connection link 8 becomes larger than the vector B1. At this time, as show in FIG. 6, since the component of force of the longitudinal direction of the connection link 8, of the vector B1, becomes larger than the vector B1, there is a risk that the load that acts on the main shaft 7*a* will become large as compared with the case of FIG. 5.

As described above, by setting the vector B1 and the vector B3 to be substantially parallel to each other at least at the predetermined crank angle, it is possible to prevent the increase of the bearing loads of the main shaft 6*a* and the main shaft 7*a*.

Next, an explanation about a rotational angle (a control shaft angle) of the first control shaft 6 will be made with reference to FIG. 7.

Figure 7A:
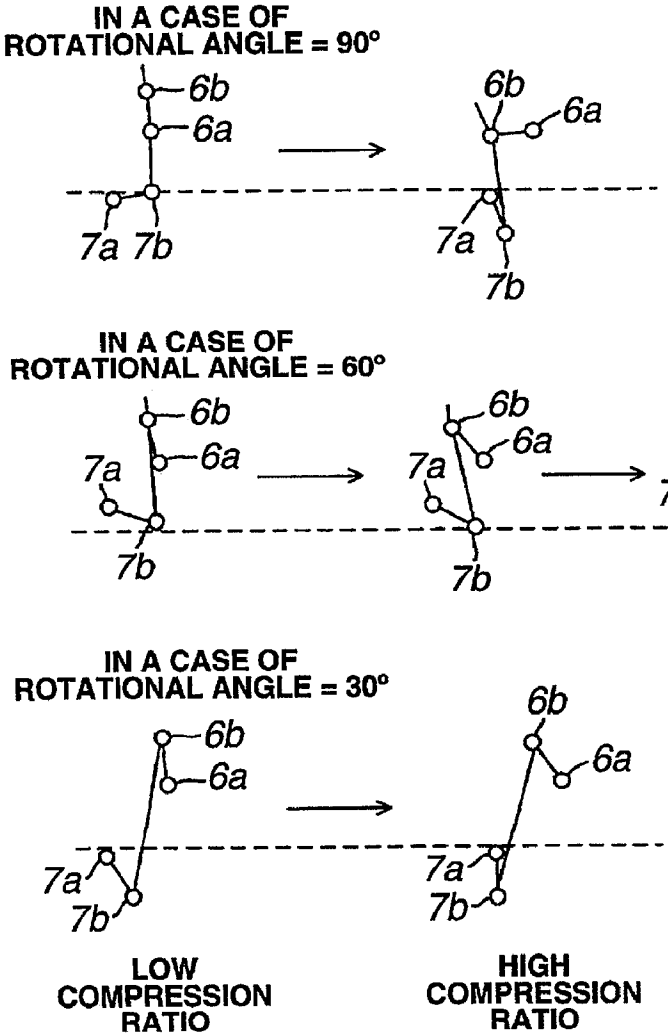
FIGS. 7A and 7B show an example of motion of the connection link 8 and the second control shaft 7 when a control shaft angle changes.
Figure 7B:
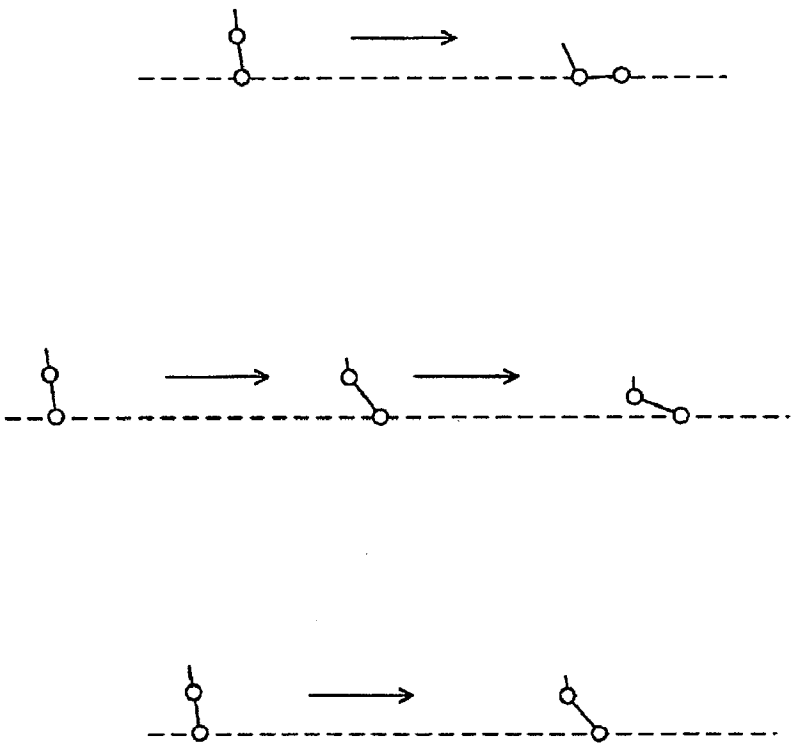
FIG.7B RELATED ART

FIG. 7A is a drawing showing an example of motion of the connection link 8 and the second control shaft 7 when the control shaft angle changes, in which the two control shafts are employed. FIG. 7B shows a case where one control shaft is employed, as in a conventional configuration. In both the FIGS. 7A and 7B, the drawing on the left hand side is low compression ratio, the drawing on the right hand side is high compression ratio.

In this embodiment, a movable range of the control shaft angle is set to be smaller than or equal to 90°. In a case where the movable range is 90° (the upper drawing in FIG. 7A), at the low compression ratio, the longitudinal direction of the connection link 8 and the direction of the main shaft 6*a* from the eccentric shaft 6*b* are substantially the same (or substantially fit to each other). For this reason, the control shaft torque that acts on the first control shaft 6 becomes minimum. Further, regarding the load that acts on the eccentric shaft 7*b*, although most of it acts in the direction that rotates the second control shaft 7, since the connection link 8 prevents the rotation of the second control shaft 7 in the same manner as FIG. 3C, the control shaft torque that acts on the second control shaft 7 becomes small.

On the other hand, at the high compression ratio, in contrast to the case of the low compression ratio, although the load that acts in the rotational direction of the first control shaft 6 becomes maximum, since the connection link 8 prevents the rotation, the control shaft torque that acts on the first control shaft 6 becomes small. In addition, since the vector of the longitudinal direction of the connection link 8 and the vector of the direction of the main shaft 7*a* from the eccentric shaft 7*b* are substantially the same (or substantially fit to each other), the control shaft torque of the second control shaft 7 becomes minimum.

Also, in the cases where the movable range is 60° (the middle drawing in FIG. 7A), and 30° (the lower drawing in FIG. 7A), at the low compression ratio, an angle formed by the vector of the longitudinal direction of the connection link 8 and the vector of the direction of the main shaft 6*a* from the eccentric shaft 6*b* becomes small, and the control shaft torque that acts on the first control shaft 6 becomes small. Further, since the rotation is prevented by the connection link 8, the control shaft torque that acts on the second control shaft 7 becomes small. In addition, at the high compression ratio, since the rotation is prevented by the connection link 8, the control shaft torque that acts on the first control shaft 6 becomes small. Since an angle formed by the vector of the longitudinal direction of the connection link 8 and the vector of the direction of the main shaft 7*a* from the eccentric shaft 7*b* becomes small, the control shaft torque that acts on the second control shaft 7 becomes small.

As shown by the case where the movable range is 60°, at the middle compression ratio as well, if the setting is made so that the angle formed by the vector of the direction of the main shaft 6*a* from the eccentric shaft 6*b* and the vector of the longitudinal direction of the connection link 8 becomes small, and also the angle formed by the vector of the direction of the main shaft 7*a* from the eccentric shaft 7*b* and the vector of the longitudinal direction of the connection link 8 becomes small, the control shaft torques that act on the first control shaft 6 and the second control shaft 7 can be reduced.

As described above, in either of these two cases of the high and low compression ratios, the control shaft torque can be reduced. Also, in the case where the fork member 11 is used, there is no increase of a bending load that acts on the actuator rod 13.

In contrast, in the case where the one control shaft is employed, like the conventional configuration, for example, as shown in FIG. 7B, at the low compression ratio, even if the setting is made so that the control shaft torque becomes small, the control shaft torque increases as the compression ratio becomes high. That is, in either of these two cases of the high and low compression ratios, it is not possible to reduce the control shaft torque.

Figure 8A:
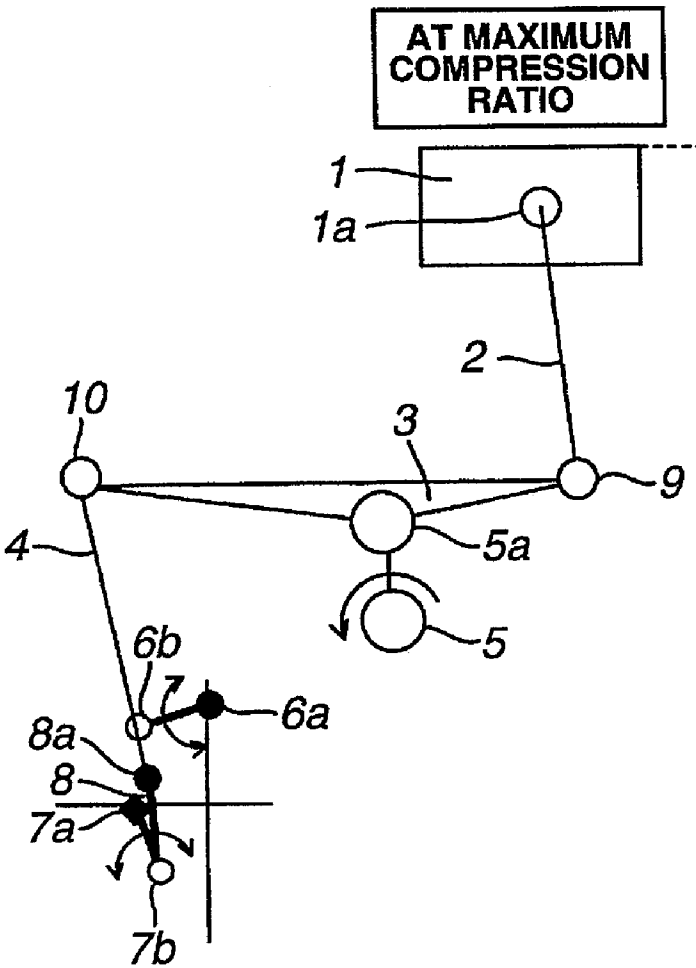
FIGS. 8A and 8B are drawings respectively showing a state of each link and each shaft, in the cases of and maximum compression ratio and minimum compression ratio.
Figure 8B:
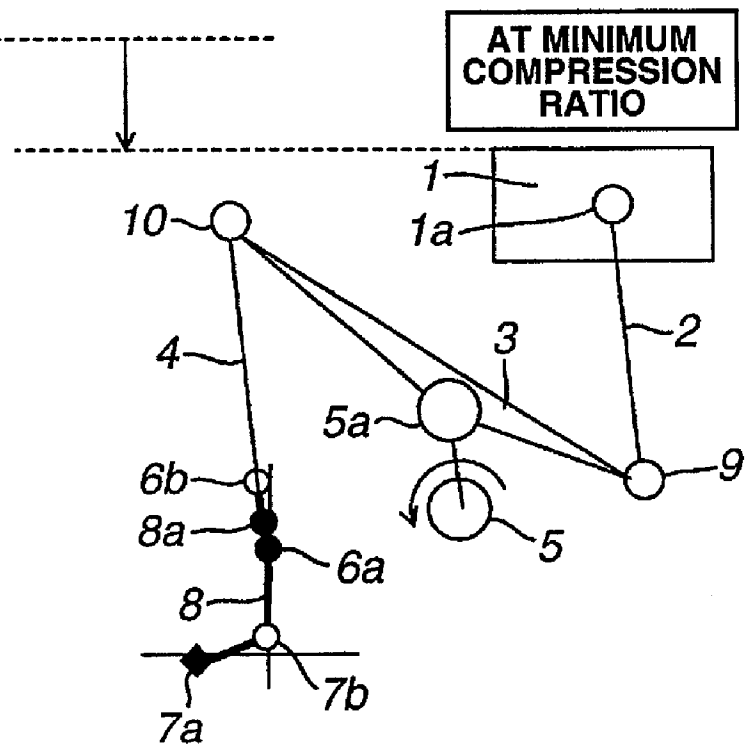

Here, with respect to the control link 4, it is not necessarily required to be linked to the first control shaft 6. For instance, as shown in FIG. 8, the control link 4 could be rotatably linked to the connection link 8. FIG. 8 shows states of the each link 2, 3, 4, 8 and each shaft 5, 6, 7 at the maximum compression ratio (FIG. 8A) and the minimum compression ratio (FIG. 8B), corresponding to FIG. 1.

Figure 9:
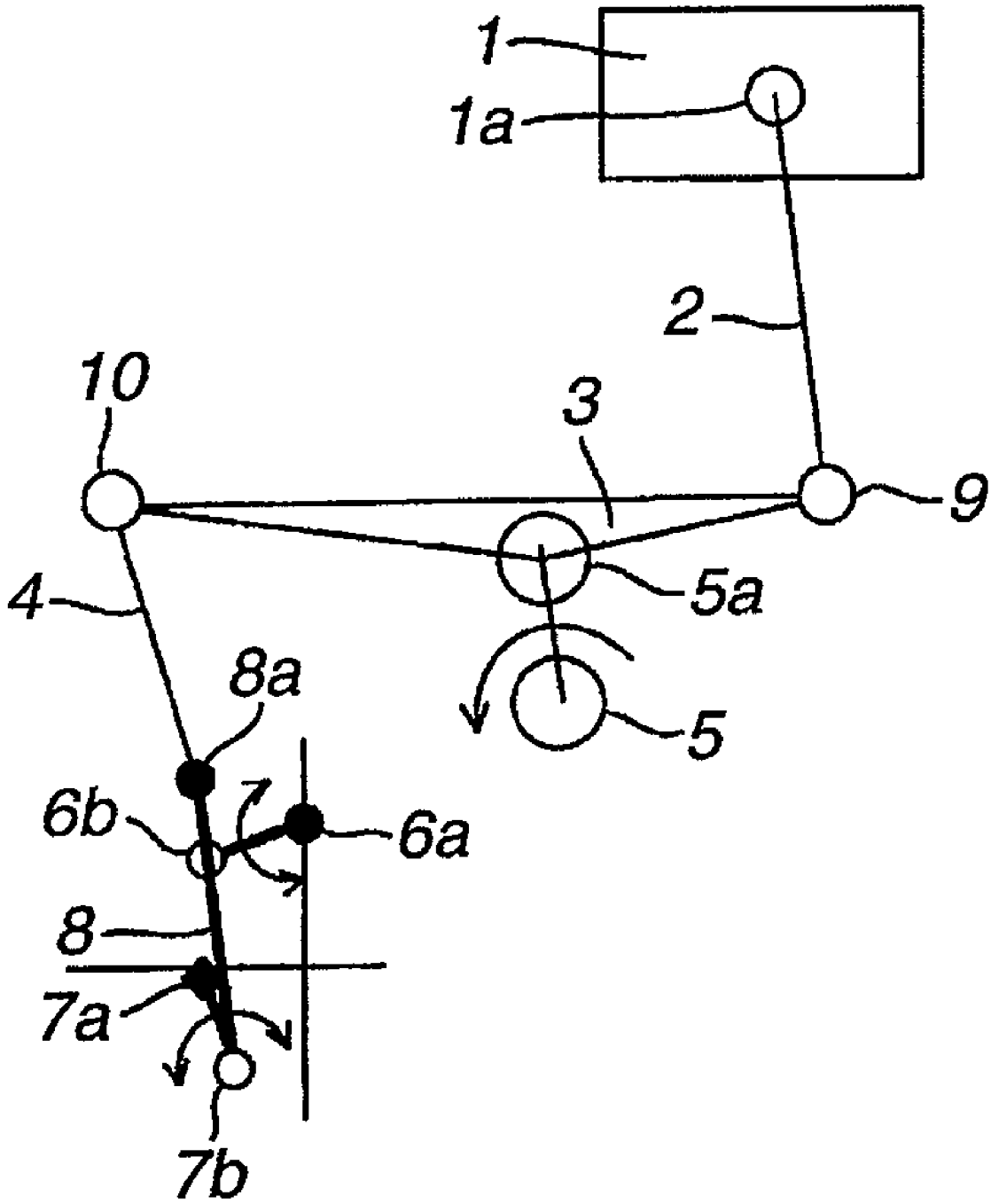
FIG. 9 is a drawing showing another example of a state of each link and each shaft.

In this case, a load that acts on the first control shaft 6 and the second control shaft 7 can be calculated from a load vector that acts on a connecting portion 8*a* where the control link 4 and the connection link 8 are connected. Further, as shown in FIG. 9, also in a case where the eccentric shaft 6*b* is nearer or closer to the eccentric shaft 7*b*, as compared with the connecting portion 8*a*, in the same manner as the above, the load can be calculated.

Accordingly, in this embodiment, the following effects can be gained.

(1) Two control shafts including the first control shaft 6 and the second control shaft 7 are employed, the first control shaft 6 has the eccentric shaft 6*b*, the connection link 8 connects the eccentric shaft 6*b* of the first control shaft 6 and the eccentric shaft 7*b* of the second control shaft 7, the other end of the control link 4 is rotatably connected to the eccentric shaft 6*b* of the first control shaft 6, and the load that acts on the eccentric shaft 6*b* of the first control shaft 6 from the control link 4 is received by the first control shaft 6 and the second control shaft 7. Thus, a combustion load and an inertial force of each movable component are shared with the two control shafts (the first control shaft 6 and the second control shaft 7), and the two control shafts (the first control shaft 6 and the second control shaft 7) receive them. Hence, the acting control shaft torque per control shaft can be reduced, and a maximum load that acts on the actuator 26 can be reduced. As a result, a load capacity of the speed reducing mechanism 16, and the holding torque of the driving side angle holding mechanism 18, can be reduced, and the actuator 26 can be downsized or miniaturized. In addition, by sharing or distributing and reducing the load that acts on the first and second control shafts 6 and 7, the shift or deviation of the compression ratio caused by distortion or stress or deformation of the actuator rod 13, can be suppressed.

(2) The two control shafts (the first control shaft 6 and the second control shaft 7) are employed, the connection link 8 connects the eccentric shaft 6*b* of the first control shaft 6 and the eccentric shaft 7*b* of the second control shaft 7, the other end of the control link 4 is rotatably connected to the connection link 8, and the load that acts on the connection link 8 from the control link 4 is received by the first control shaft 6 and the second control shaft 7. Thus, as in the above, the downsizing of the actuator 26 and the suppression of the deviation of the compression ratio caused by deformation, etc. of the actuator rod 13 can be possible.

(3) The above holding unit sets the arrangement (or position) and size (or length) of the each link 2, 3, 4 and the arrangement (or position) etc. of the crank shaft 5 and the first and second control shafts 6 and 7, so that the torque required to hold the above control shafts at predetermined rotational positions becomes substantially minimum at the maximum compression ratio and the minimum compression ratio. Thus, the control shaft torque at the maximum compression ratio and the minimum compression ratio can be substantially minimized, and also the control shaft torque at the medium compression ratio can be reduced. That is, the control shaft torque can be reduced throughout the compression ratio from the maximum compression ratio to the minimum compression ratio. Therefore, since a holding torque limitation of the angle holding mechanism 18, 20 can be reduced, and also an input load to the speed reducing mechanism 16, 19 and the actuator rod 13 can be reduced, the actuator 26 can be considerably minimized, and an occurrence of noise and vibration from the actuator 26 can be reduced.

(4) At either one of the maximum compression ratio or the minimum compression ratio, the vector B1 and the vector B2 become closest to the parallel state within the movement range of the vector B1 and the vector B2. At the other compression ratio, the vector B3 and the vector B4 become closest to the parallel state within the movement range of the vector B3 and the vector B4. Thus, when the vector B1 and the vector B2 become closest to the parallel state, the control shaft torque, in the rotational direction of the first control shaft 6, required to hold the control shaft angle, becomes minimum, and the load that acts on the actuator 26 can be minimized. When the vector B3 and the vector B4 become closest to the parallel state, the control shaft torque in the rotational direction of the second control shaft 7 becomes minimum, and the load that acts on the actuator 26 due to the friction that exists at the main shaft 7*a* of the second control shaft 7 can be reduced when holding the control shaft angle of the first control shaft 6. Therefore, the control shaft torque can be reduced throughout the compression ratio, and the load that acts on the actuator 26 can be reduced throughout the compression ratio.

(5) When the directions of the vector B1 and the vector B2 become closest to the parallel state within the movement range, the load that acts on the second control shaft 7 is smaller than the load that acts on the first control shaft 6. When the directions of the vector B3 and the vector B4 become closest to the parallel state within the movement range, the load that acts on the first control shaft 6 is smaller than the load that acts on the second control shaft 7. Thus, when the angle formed by the direction of the main shafts 6*a* and 7*a* from the eccentric shafts 6*b* and 7*b*, and the acting direction of the load that acts on the first and second control shafts 6 and 7 becomes smallest, a larger load is received. Therefore, it is possible to hold the rotational angles of the first and second control shafts 6 and 7 by a smaller force, and the load that acts on the actuator 26 can be reduced irrespective of the compression ratio.

(6) When the load that acts on the second control shaft 7 is larger than the load that acts on the first control shaft 6, the vector B2 and the vector B3 are substantially perpendicular to each other. Thus, in the condition in which a relationship between the vectors B1~B4, and the load that acts on the first and second control shafts 6 and 7, is the relationship of the above (5), the maximum load that acts on the connection link 8 can be reduced, and therefore the connection link 8 can be minimized.

(7) Since the vector B1 and the vector B3 become parallel to each other at least one crank angle during an engine operation, the occurrence of the bearing load of the first control shaft 6 and the increase of the vector B3 can be avoided.

(8) The common first control shaft 6 to all cylinders is employed, the control links 4 of all the cylinders arranged in the same cylinder line are connected to the first control shaft 6, and the second control shaft 7 is linked to the first control shaft 6 via at least one connection link 8. Thus, the number of the connection link 8 can be smaller than that of the cylinder, and therefore the length of the second control shaft 7 can be shorter than that of the first control shaft 6, and a compact design becomes possible. Also, by arranging the connection link 8 at either one or both of the fore-end and the rear-end of the cylinder line, it is possible to arrange the connection link 8 without interfering with the bearing portion between the control link 4 and the first and second control shafts 6 and 7.

(9) The driving side angle holding mechanism 18 is provided at the first control shaft 6, and the non-driving side angle holding mechanism 20 is provided at the second control shaft 7, and one of the mechanism 18, 20 which can hold the angles of the first and second control shafts 6, 7 with a smaller holding torque is operated in accordance with the compression ratio. Thus, since the holding torque required of the driving side angle holding mechanism 18 and the non-driving side angle holding mechanism 20 can be small, a compact design becomes possible.

(10) Since the electric motor 17 drives the first control shaft 6, and also the vector B3 and the vector B4 do not become parallel to each other, it is possible to prevent an increase of an output required to rotate the first control shaft 6, of the electric motor 17. Therefore, the electric motor 17 always drives the first control shaft 6 irrespective of the compression ratio.

Here, even in a case where FIG. 3A is the minimum compression ratio and FIG. 3C is the maximum compression ratio, the same effects can be rained.

Figure 10:
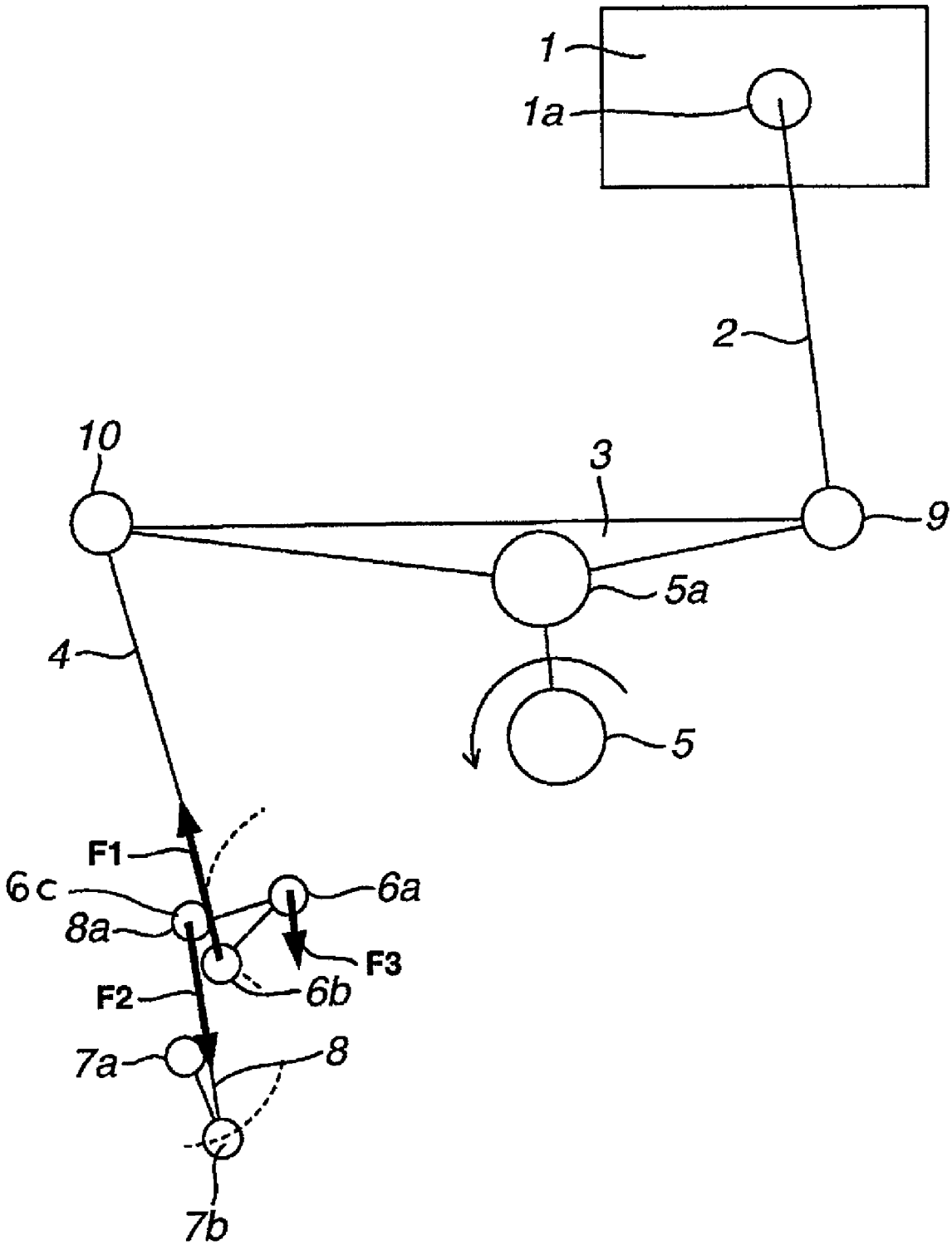
FIG. 10 is a schematic view of a configuration of a variable compression ratio mechanism of a second embodiment (viewed from the front of the engine).

Next, a second embodiment will be explained with reference to FIG. 10. FIG. 10 is a schematic view of a configuration of a multiple link type link variable compression ratio mechanism of the second embodiment.

The configuration of the second embodiment is basically the same as that of the first embodiment, but a different point is that the eccentric shaft 6*b* to which the control link 4 is connected, and the connecting portion 8*a* to which the connection link 8 is connected, are located or arranged at different positions of the first control shaft 6. In FIG. 10, an arrow F1 indicates a load that acts on the eccentric shaft 6*b* from the control link 4, an arrow F2 indicates a load that acts on the eccentric shaft 7*b* from the connection link 8, and an arrow F3 indicates a load that acts on the main shaft 6*a*.

As shown in FIG. 10, the eccentric shaft 6*b* and the connecting portion 8*a* are substantially located in the same direction with respect to the main shaft 6*a*. In this case, although the load F1 acts on the eccentric shaft 6*b* and the load F2 acts on the eccentric shaft 7*b*, these are cancelled. As a result, the load F3 that acts on the main shaft 6*a* can be reduced.

As described above, according to this embodiment, the following effects, other than the same effects as the first embodiment, can be gained.

(1) The two control shafts (the first control shaft 6 and the second control shaft 7) are employed, the first control shaft 6 has first and second eccentric shafts 6*b* and 6*c*, the connection link 8 connects the second eccentric shaft 6*c* of the first control shaft 6 and the eccentric shaft 7*b* of the second control shaft 7, the other end of the control link 4 is rotatably connected to the first eccentric shaft 6*b* of the first control shaft 6, and the load that acts on the first eccentric shaft 6*b* of the first control shaft 6 from the control link 4 is received by the first control shaft 6 and the second control shaft 7. Thus, the same effects as (1) and (2) of the first embodiment can be gained.

(2) Since the first eccentric shaft 6*b* and the second eccentric shaft 6*c* of the first control shaft 6 are located in the substantially same direction with respect to an axis of the first control shaft 6, the load that acts on the first control shaft 6 from the control link 4, and the load that acts on the first control shaft 6 from the connection link 8 are cancelled, and the load that acts on the main shaft 6*a* of the first control shaft 6 can be reduced.

Figure 11:
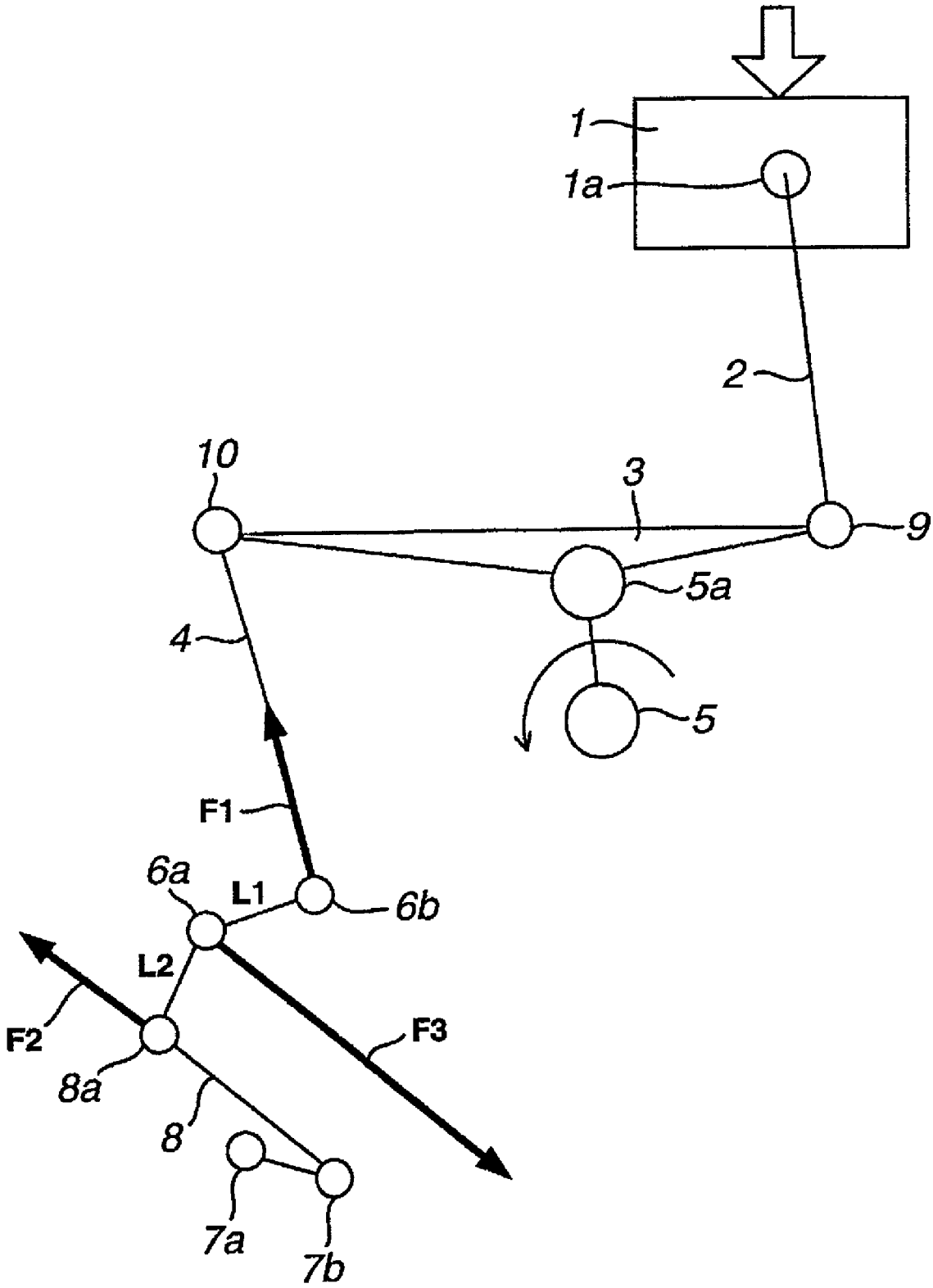
FIG. 11 is a schematic view of a configuration of a variable compression ratio mechanism of a third embodiment (viewed from the front of the engine).

Next, a third embodiment will be explained with reference to FIG. 11. FIG. 11 is a schematic view of a configuration of a multiple link type link variable compression ratio mechanism of the third embodiment.

The configuration of this embodiment is basically the same as that of the second embodiment, but a different point is that the eccentric shaft 6*b* and the connecting portion 8*a* are located at opposite sides of the main shaft 6*a*.

In this embodiment, a length from the main shaft 6*a* to the eccentric shaft 6*b* is L1, and a length from the main shaft 6*a* to the connecting portion 8*a* is L2. Then, the positions or arrangement of the eccentric shaft 6*b* and the connecting portion 8*a* are set so that the product of the load F1 and the length L1 is equal to the product of the load F2 and the length L2.

By this setting, since the control shaft torque by the load F1 and the control shaft torque by the load F2 are cancelled, no control shaft torque acts on the first control shaft 6.

On the other hand, in the case where the eccentric shaft 6*b* and the connecting portion 8*a* are located at opposite sides of the main shaft 6*a*, although the condition in which the control shaft torque that acts on the first control shaft 6 is cancelled is the same as the above condition, a resultant force of the load F1 and the load F2 becomes the load F3 that acts on the main shaft 6*a*, and the load F3 becomes great as compared with the second embodiment.

However, for example, by positioning or arranging the second control shaft 7 in a transverse or lateral direction of the first control shaft 6, heights of peripheral portions of the first and second control shafts 6 and 7 can be reduced. In this case also, regarding the vectors B1~B4, these are arranged so that the above mentioned relationship is established.

As described above, in this embodiment, the following effects other than the effects equivalent to the first embodiment can be gained.

Since the first eccentric shaft 6*b* and the second eccentric shaft 6*c* of the first control shaft 6 are located in the different direction with respect to the axis of the first control shaft 6, for instance, by arranging the second control shaft 7 in the transverse or lateral direction of the first control shaft 6, the length of the mechanism formed from the first control shaft 6, the connection link 8, and the second control shaft 7, can be reduced.

Next, a fourth embodiment will be explained with reference to FIG. 12.

Figure 12B:
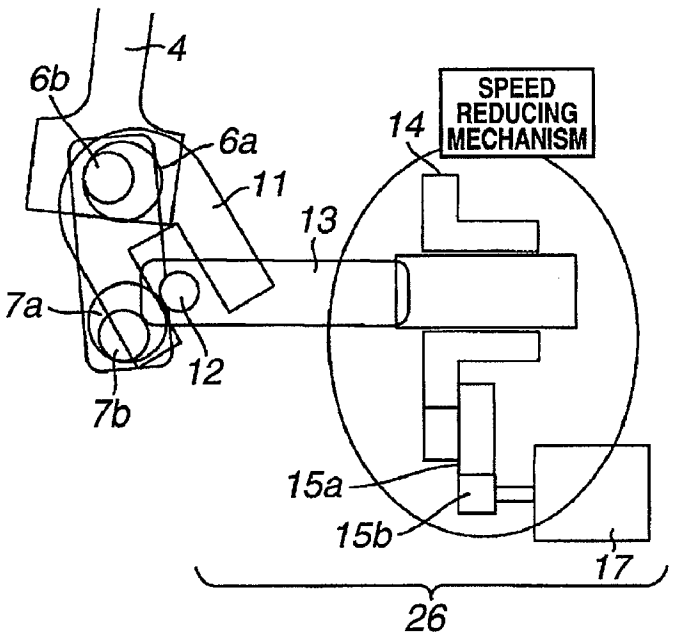
FIGS. 12A and 12B are schematic views of a configuration around the first and the second control shafts, respectively viewed from the front and a side of the engine, according to a fourth embodiment.
Figure 12A:
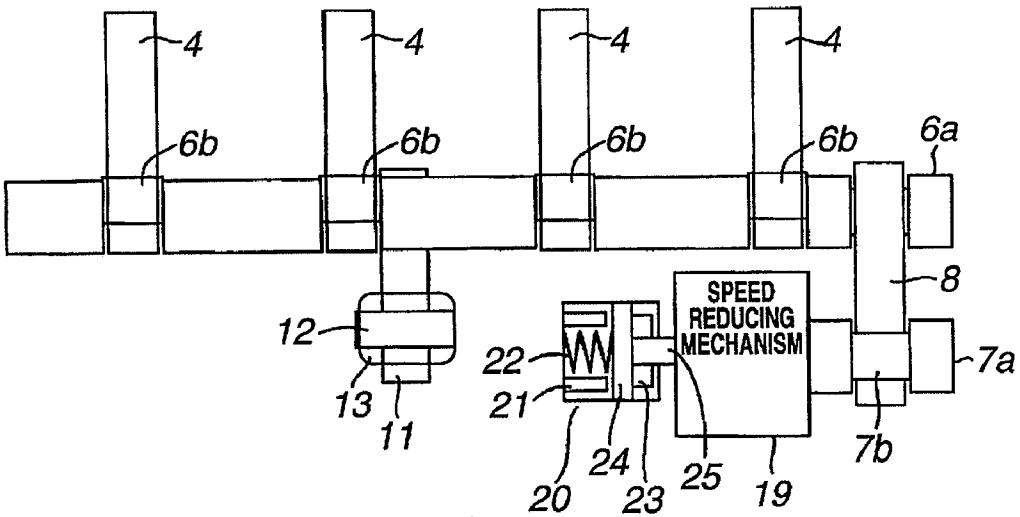

FIG. 12 is a drawing that is basically the same as FIG. 2, except that the driving side angle holding mechanism 18 is not employed.

In this embodiment, the assumption is made that a friction torque in the rotational direction of the main shaft 6*a* of the first control shaft 6 is greater than a friction torque around the main shaft 7*a* of the second control shaft 7. In order to provide the difference of the friction torque, for instance, a surface of the main shaft 6*a* is made so that its roughness is rougher than that of the main shaft 7*a*, or a diameter of the main shaft 6*a* is set to be greater than that of the main shaft 7*a*, or a clearance between the bearing and the main shaft 6*a* is set to be smaller than that of the main shaft 7*a*.

By such setting, in a case where the angle is held by the first control shaft 6 side, that is, the control shaft torque that acts on the first control shaft 6 is smaller than the control shaft torque that acts on the second control shaft 7, since the control shaft torque that acts on the first control shaft 6 is reduced by the friction torque, the hold by the electric motor 17 is possible with little power consumption. Further, a required magnitude or strength of an electromagnetic brake becomes small, therefore the electric motor 17 can be minimized by a side corresponding to this magnitude and an engine size can be minimized. Here, in a case where an absolute value of the control shaft torque is great, although the driving side angle holding mechanism 18 is needed, its size can be relatively small.

On the other hand, in a case where the angle is held by the second control shaft 7 side, that is, the control shaft torque that acts on the first control shaft 6 is greater than the control shaft torque that acts on the second control shaft 7, since the friction torque of the main shaft 7*a* of the second control shaft 7 is small, there is no control shaft torque reduction effect by the friction torque.

Thus, the setting that the above mentioned vector B3 and the vector B4 substantially become close to the parallel state is made. By this setting, since the control shaft torque that acts on the second control shaft 7 is reduced, the torque required to hold the angle is reduced, and the non-driving side angle holding mechanism 20 can be minimized. Here, in a case where the friction of the main shaft 7*a* of the second control shaft 7 is great under the condition in which the vector B3 and the vector B4 substantially become close to the parallel state, the torque required to rotate the first control shaft 6, of the electric motor 17 is increased, and the drive by the electric motor 17 becomes difficult. However, if the friction torque of the main shaft 7*a* of the second control shaft 7 is set to be small, like in the instant embodiment, such a problem does not arise.

As described above, according to this embodiment, the following effects other than the same effects as the first embodiment can be gained.

The first control shaft 6 that is driven by the electric motor 17 is a driving side control shaft, the second control shaft 7 is a non-driving side control shaft, the friction torque of the main shaft 6*a* of the driving side control shaft 6 is grater than the friction torque of the main shaft 7*a* of the non-driving side control shaft 7, and the non-driving side angle holding mechanism 20 is employed at least the non-driving side control shaft 7. Thus, in the case where the angle is held by the first control shaft 6 side, the hold by the electric motor 17 is possible with little power consumption. On the other hand, in a case where the angle is held by the second control shaft 7 side, by the setting that the vector B3 and the vector B4 substantially become close to the parallel state, the control shaft torque that acts on the second control shaft 7 can be reduced, and the torque required to hold the angle can be reduced, and the non-driving side angle holding mechanism 20 can be minimized.

Next, a fifth embodiment will be explained with reference to FIG. 13.

Figure 13B:
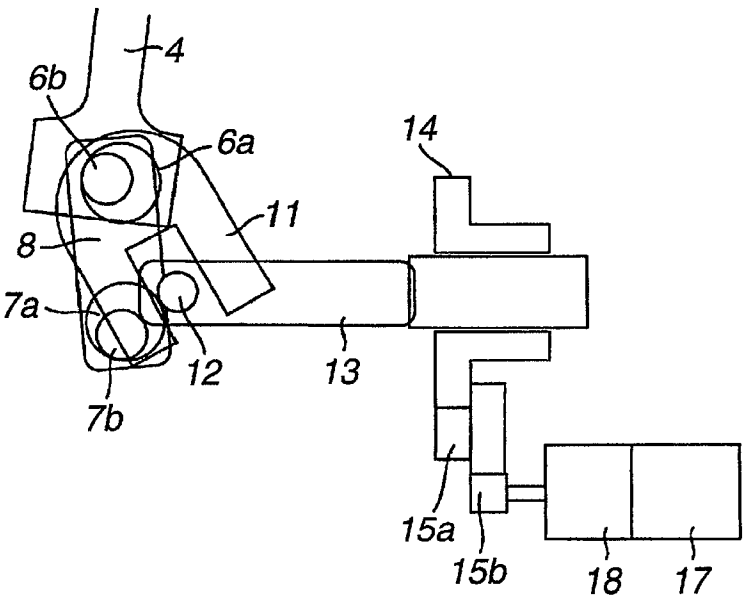
FIGS. 13A and 13B are schematic views of a configuration around the first and the second control shafts, respectively viewed from the front and a side of the engine, according to a fifth embodiment.
Figure 13A:
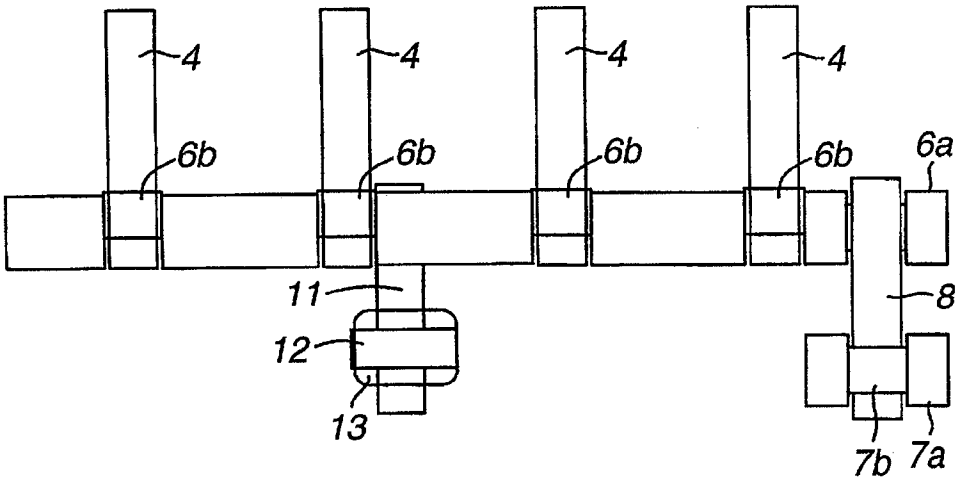

FIG. 13 is a drawing that is basically the same as FIG. 2, except that the non-driving side angle holding mechanism 20 is not employed.

In this embodiment, the assumption is made that the friction torque in the rotational direction of the main shaft 6*a* of the first control shaft 6 is greater than the friction torque around the main shaft 7*a* of the second control shaft 7. This difference of the friction is realized by an opposite setting to the third embodiment.

By this setting, in the case where the angle is held by the second control shaft 7 side, since the friction torque of the main shaft 7*a* of the second control shaft 7 is great, the control shaft torque that acts on the first control shaft 6 is considerably reduced. Therefore, even though the non-driving side angle holding mechanism 20 is not employed at the second control shaft 7 side, the holding is possible by the driving side angle holding mechanism 18 employed at the first control shaft 6 side.

In addition, in a case where it is easy to hold the angle by the first control shaft 6 side, the holding can be done by the driving side angle holding mechanism 18. In this case, the vector B3 and the vector B4 have to be set so that the angle formed by the vector B3 and the vector B4 is not substantially parallel, because if the control shaft torque in the rotational direction of the main shaft 7*a* of the second control shaft 7 is great when the vector B3 and the vector B4 become close to the parallel state, the second control shaft 7 is put in a holding state by only the friction torque, and this is prevented.

As described above, according to this embodiment, the following effects other than the same effects as the first embodiment can be gained.

From the first and second control shafts 6 and 7, the first control shaft 6 that is driven by the electric motor 17 is the driving side control shaft, the second control shaft 7 is the non-driving side control shaft, the friction torque of the main shaft 6*a* of the driving side control shaft 6 is smaller than the friction torque of the main shaft 7*a* of the non-driving side control shaft 7, the driving side angle holding mechanism 18 is employed at least the driving side control shaft 6, and the vector B3 and the vector B4 do not become substantially parallel. Thus, in the case where the angle is held by the second control shaft 7 side, since the non-driving side angle holding mechanism 20 is not needed, the configuration becomes simple, reducing costs. In addition, since the holding torque required of the driving side angle holding mechanism 18 is also reduced throughout the compression ratio, the driving side angle holding mechanism 18 can be minimized.

Next, a sixth embodiment will be explained with reference to FIG. 14.

Figure 14C:
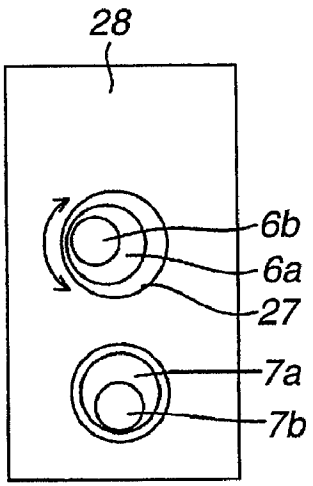
FIG. 14C is a drawing showing a bearing portion, according to a sixth embodiment.
Figure 14B:
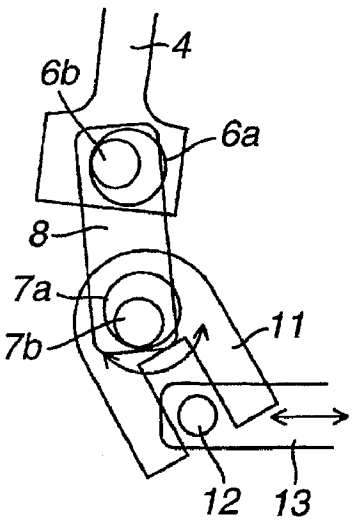
FIGS. 14A and 14B are schematic views of a configuration around the first and the second control shafts, respectively viewed from the front and from a side of the engine.
Figure 14A:
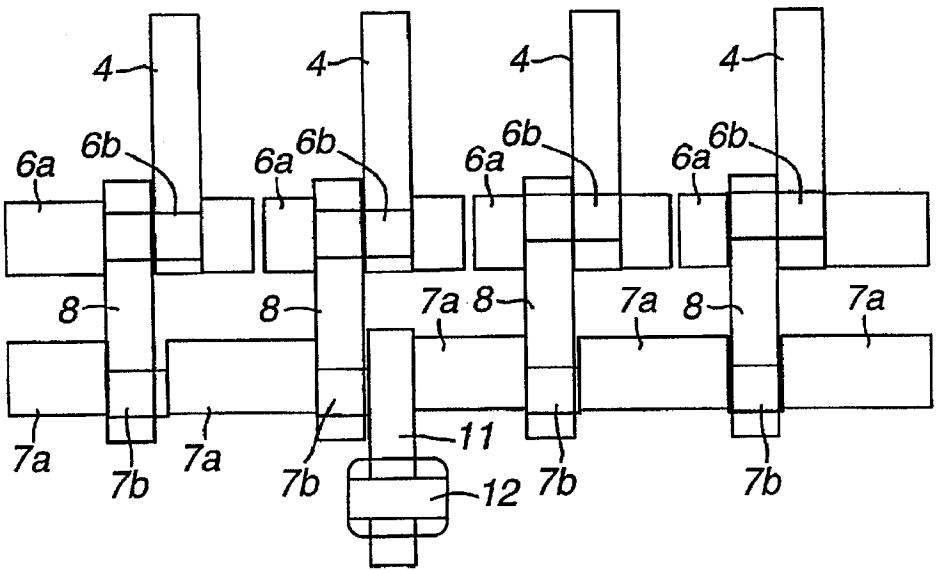

FIGS. 14A and 14B are drawings that shows states of the first control shaft 6, the second control shaft 7, and the connection link 8, corresponding to FIG. 2. FIG. 14C is a drawing showing bearing portions of the first control shaft 6 and the second control shaft 7.

In this embodiment, the main shaft 6*a* of the first control shaft 6 which is independent for each cylinder is employed, and the control link 4 and the connection link 8 are employed for each cylinder. In contrast, as for the second control shaft 7, the one common second control shaft 7 to all the cylinders, which extends in the direction of the cylinder line, is employed. The fork member 11 is connected with the second control shaft 7.

As shown in FIG. 14C, the main shaft 6*a* of the first control shaft 6 is supported by a bearing 28 via an eccentric bearing 27. By relatively rotating the eccentric bearing 27 with respect to the bearing 28, a position of the main shaft 6*a* can be changed. That is, the eccentric bearing 27 has a function that controls or adjusts or regulates variations of the compression ratio.

With this configuration, it becomes possible to change compression ratios of all the cylinders at the same time. In addition to this, the variations of the compression ratio between the cylinders can be controlled or suppressed.

As described above, according to this embodiment, the following effects other than the same effects as the first embodiment can be gained.

The first control shaft 6 which is split for each cylinder and is capable of independently rotating, and the common second control shaft 7 to all the cylinders, are employed, the each first control shaft 6 is connected to the second control shaft 7 via the connection link 8, and also each control link 4 connects with the respective first control shaft 6, the change of the compression ratios of all the cylinders at the same time can be possible by driving the second control shaft 7 with the electric motor 17, and the eccentric bearing 27 is provided at the bearing portion of the main shaft 6*a* of the first control shaft 6. Thus, it is possible to reduce the variations of the compression ratio between the cylinders.

While the invention has been disclosed with reference to certain preferred embodiments, numerous modifications, alterations, and changes to the described embodiments are possible without departing from the sphere and scope of the invention, as defined in the appended claims and equivalents thereof. Accordingly, it is intended that the invention not be limited to the described embodiments, but that it have the full scope defined by the language of the following claims.

The invention claimed is:

1. An internal combustion engine which varies a compression ratio by changing a top dead center position of a piston, comprising:

an engine block;

the piston disposed in the engine block;

a crank shaft supported by the engine block;

a plurality of links connecting the piston and the crank shaft;

a first control shaft and a second control shaft respectively supported by the engine block, each of which has a main shaft portion rotatably supported by the engine block and an eccentric portion eccentric to the main shaft portion, the eccentric portions of the first control shaft and the second control shaft deviating from axes of the respective main shaft portions in mutually different directions when viewed from an axial direction;

a plurality of control links which connect any one of the plurality of links connecting the piston and the crank shaft, and the first control shaft and the second control shaft; and a driving unit which is provided at least one of the first control shaft and the second control shaft, that rotates the control shaft.

2. The internal combustion engine as claimed in claim 1, wherein the plurality of control links includes a first control link that links the first control shaft and the second control shaft, and a second control link that links any one of the plurality of links connecting the piston and the crank shaft, and the first control shaft.

3. The internal combustion engine as claimed in claim 2, wherein first to fourth vectors are defined as follows:

the first vector is a load vector that acts on a connecting portion between the first control shaft and the second control link, the second vector is a vector of a direction of an eccentric axis of the first control shaft from an axis of the main shaft of the first control shaft, the third vector is a vector of a longitudinal direction of the first control link, and the fourth vector is a vector of a direction of an eccentric axis of the second control shaft from an axis of the main shaft of the second control shaft, at either one of a substantially maximum compression ratio or a substantially minimum compression ratio, the first vector and the second vector become closest to a parallel state within a movement range of the first vector and the second vector, and at the other compression ratio, the third vector and the fourth vector become closest to a parallel state within a movement range of the third vector and the fourth vector.

4. The internal combustion engine as claimed in claim 3, wherein when directions of the first vector and the second vector become closest to the parallel state within the movement range, a load that acts on the second control shaft is smaller than a load that acts on the first control shaft, and when directions of the third vector and the fourth vector become closest to the parallel state within the movement range, the load that acts on the first control shaft is smaller than the load that acts on the second control shaft.

5. The internal combustion engine as claimed in claim 3, wherein when a load that acts on the second control shaft is greater than a load that acts on the first control shaft, the second vector and the third vector are substantially perpendicular to each other.

6. The internal combustion engine as claimed in claim 3, wherein the first vector and the third vector become parallel to each other at least one crank angle during an engine operation.

7. The internal combustion engine as claimed in claim 2, wherein the first control shaft has a first eccentric shaft and a second eccentric shaft respectively eccentric to the main shaft portion, and the first control link links the first eccentric shaft of the first control shaft and the eccentric shaft of the second control shaft, and the first eccentric shaft of the first control shaft and the second control shaft are located in a substantially same direction with respect to an axis of the main shaft of the first control shaft.

8. The internal combustion engine as claimed in claim 2, wherein the first control shaft has a first eccentric shaft and a second eccentric shaft respectively eccentric to the main shaft portion, and the first control link links the first eccentric shaft of the first control shaft and the eccentric shaft of the second control shaft, and the first eccentric shaft of the first control shaft and the second control shaft are located in a substantially different direction with respect to an axis of the main shaft of the first control shaft.

9. The internal combustion engine as claimed in claim 2, wherein the internal combustion engine is a multiple cylinder internal combustion engine, and includes:

a first control shaft which is split for the each cylinder and is capable of independently rotating;

an adjustment eccentric bearing provided at a bearing portion of the main shaft of the first control shaft;

a second control shaft common to all the cylinders;

a first control link which connects the first control shaft and the second control shaft for each cylinder;

a second control link that links any one of the plurality of links connecting the piston and the crank shaft, and the first control shaft for each cylinder; and a driving unit which is provided at the second control shaft, that drives a rotation of the control shaft within a predetermined control range.

10. The internal combustion engine as claimed in claim 2, wherein the internal combustion engine is a multiple cylinder engine, and includes: a first control shaft common to all the cylinders, to which the second control link of all the cylinders arranged in a same cylinder tine connects; and at least one first control link which links the first control shaft and the second control shaft.

11. The internal combustion engine as claimed in claim 2, including:

a driving unit which is provided at either one of the first control shaft and the second control shaft, that drives a rotation of the control shaft within a predetermined control range; and a holding mechanism which is provided at the same control shaft as the control shaft employing the driving unit, that holds the control shaft at a predetermined rotational position, wherein a friction torque of the control shaft employing the holding mechanism is greater than a friction torque of the main shaft portion of the control shaft employing the driving unit, when third and fourth vectors are defined as follows;

the third vector is a vector of a longitudinal direction of the first control link, the fourth vector is a vector of a direction of an eccentric axis of the second control shaft from an axis of the main shaft of the second control shaft, and the third vector and the fourth vector do not become parallel.

12. The internal combustion engine as claimed in claim 11, wherein:

the driving unit drives the first control shaft.

13. The internal combustion engine as claimed in claim 1, wherein the plurality of control links includes a first control link that links the first control shaft and the second control shaft, and a second control link that links any one of the plurality of links connecting the piston and the crank shaft, and the first control link.

14. The internal combustion engine as claimed in claim 13, wherein first to third vectors are defined as follows:

the first vector is a vector of a direction of an eccentric axis of the first control shaft from an axis of the main shaft of the first control shaft, the second vector is a vector of a longitudinal direction of the first control link, and the third vector is a vector of a direction of an eccentric axis of the second control shaft from an axis of the main shaft of the second control shaft, at either one of a substantially maximum compression ratio or a substantially minimum compression ratio, the second vector and the first vector become closest to a parallel state within a movement range of the second vector and the first vector, and at the other compression ratio, the second vector and the third vector become closest to a parallel state within a movement range of the second vector and the third vector.

15. The internal combustion engine as claimed in claim 14, wherein when directions of the third vector and the second vector become closest to the parallel state within the movement range, a load that acts on the second control shaft is smaller than a load that acts on the first control shaft, and when directions of the third vector and the fourth vector become closest to the parallel state within the movement range, the load that acts on the first control shaft is smaller than the load that acts on the second control shaft.

16. The internal combustion engine as claimed in claim 14, wherein when a load that acts on the second control shaft is greater than a load that acts on the first control shaft, the second vector and the third vector are substantially perpendicular to each other.

17. The internal combustion engine as claimed in claim 1, comprising:

a holding mechanism which holds the first control shaft and the second control shaft at predetermined rotational positions, wherein a torque required to hold the control shafts at the predetermined rotational positions by the holding mechanism becomes substantially minimum at a maximum compression ratio and at a minimum compression ratio.

18. The internal combustion engine as claimed in claim 1, further comprising:

a first holding mechanism provided at the first control shaft; and a second holding mechanism provided at the second control shaft, wherein one of the first and second holding mechanisms, which is able to hold angles of the first control shaft and the second control shaft with a smaller torque, is operated.

19. The internal combustion engine as claimed in claim 1, including:

a driving unit which is provided at either one of the first control shaft and the second control shaft, that drives a rotation of the control shaft within a predetermined control range; and a holding mechanism which is provided at least the other control shaft, that holds the control shaft at a predetermined rotational position, wherein a friction torque of the control shaft employing holding mechanism is greater than a friction torque of the main shaft portion of the control shaft employing the driving unit.

20. A method of varying a compression ratio of an internal combustion engine by changing a top dead center position of a piston, the engine including an engine block, the piston, a crank shaft, and a plurality of links connecting the piston and the crank shaft, the method comprising:

providing a first control shaft and a second control shaft respectively supported by the engine block, each of which has a main shaft portion rotatably supported by the engine block and an eccentric portion eccentric to the main shaft portion, the eccentric portions of the first control shaft and the second control shaft deviating from axes of the respective main shaft portions in mutually different directions when viewed from an axial direction;

providing a plurality of control links which connect any one of the plurality of links connecting the piston and the crank shaft, and the first control shaft and the second control shaft; and operating a driving unit that rotates at least one of the first control shaft and the second control shaft.

* * * * *